United States Patent [19]

York et al.

[11] Patent Number: 4,548,702

[45] Date of Patent: Oct. 22, 1985

[54] SHALE OIL STABILIZATION WITH A HYDROPROCESSOR

[75] Inventors: Earl D. York, Englewood; David M. Johnson, Littleton, both of Colo.; Paul B. Miller, Odessa, Tex.

[73] Assignees: Standard Oil Company; Gulf Oil Corporation, both of Chicago, Ill.

[21] Appl. No.: 583,320

[22] Filed: Feb. 24, 1984

[51] Int. Cl.[4] ..... C10G 1/00

[52] U.S. Cl. ..... 208/11 R; 208/89

[58] Field of Search ..... 208/11 R, 56, 89, 107

[56] References Cited

U.S. PATENT DOCUMENTS

| | | | |
|---|---|---|---|
| 2,692,226 | 10/1954 | Smith | 208/11 R |
| 3,297,563 | 1/1967 | Doumani | 208/89 X |
| 3,558,475 | 1/1971 | Jaffe | 208/89 X |
| 3,565,751 | 2/1971 | Hoekstra | 208/11 R X |
| 3,655,518 | 4/1972 | Schmalfeld et al. | 208/11 R X |
| 4,022,683 | 6/1977 | Bludis et al. | 208/89 X |
| 4,029,571 | 6/1977 | Curtin | 208/107 X |
| 4,101,416 | 7/1978 | Dolbear | 208/108 |
| 4,115,246 | 9/1978 | Sweany | 208/56 |
| 4,155,832 | 5/1979 | Cox et al. | 208/11 R X |
| 4,324,643 | 4/1982 | Durai-Suamy | 208/11 R X |
| 4,344,840 | 8/1982 | Kunesh | 208/11 R X |
| 4,366,047 | 12/1982 | Winter et al. | 208/107 X |
| 4,415,430 | 11/1983 | York | 208/11 R X |
| 4,415,434 | 11/1983 | Hargreaves et al. | 208/11 R |

*Primary Examiner*—D. E. Gantz
*Assistant Examiner*—Glenn A. Caldarola
*Attorney, Agent, or Firm*—Thomas W. Tolpin; William T. McClain; William H. Magidson

[57] ABSTRACT

A process is provided to produce, stabilize, dedust and upgrade synthetic oil, such as shale oil. In the process, synthetic fuels, such as oil shale, tar sands and diatomite are retorted with heat carrier material to liberate an effluent product stream comprising hydrocarbons and entrained particulates of dust. In order to minimize polymerization of the product stream and agglomerate the dust, the product stream is stabilized, upgraded, and pretreated prior to dedusting, in a hydroprocessor, such as an ebullated bed reactor, with a hydroprocessing gas in the presence of a catalyst. The hydroprocessing gas can be hydrogen, scrubbed fractionator gases, or hydrocarbon-enriched hydroprocessor off gases.

22 Claims, 2 Drawing Figures

SHALE OIL STABILIZATION WITH A HYDROPROCESSOR

BACKGROUND OF THE INVENTION

This invention relates to oil shale, and more particularly, to a surface retorting process for producing, stabilizing, and dedusting shale oil.

Researchers have renewed their efforts to find alternate sources of energy and hydrocarbons in view of past rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resouces.

Generally, oil shale is a fine-grained sedimentary rock stratified in horizontal layers with a variable richness of kerogen content. Kerogen has limited solubility in ordinary solvents and therefore cannot be efficiently converted to oil by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is upgraded crude shale oil.

The process of pyrolyzing the kerogen in oil shale, known as retorting, to form liberated hydrocarbons can be done in surface retorts in aboveground vessels or in in situ retorts underground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In surface retorting, oil shale is mined from the ground, brought to the surface, crushed and placed in vessels where it can be contacted with a hot solid heat carrier material, such as hot spent shale, ceramic balls, metal balls, or sand or a gaseous heat carrier material, such as light hydrocarbon gases, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material can be removed from the retort and recycled as heat carrier material or discarded. The combustion gases are dedusted in cyclones, electrostatic precipitators, or other gas-solid separation systems.

During fluid bed, moving bed and other types of surface retorting, decrepitation of oil shale occurs when particles of oil shale collide with each other or impinge against the walls of the retort forming substantial quantities of minute entrained particulates of shale dust. The use of hot spent shale as heat carrier material can aggravate the dust problem. Rapid retorting is desirable to minimize thermal cracking of valuable condensable hydrocarbons. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sands, gilsonite, and oil-containing diatomaceous earth create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it can be separated into fractions of light gases, light oils, middle oils and heavy oils with the bottom heavy oil fraction containing essentially all of the dust. As much as 65% by weight of the bottom heavy oil fraction may consist of dust.

It is very desirable to upgrade the bottom heavy oil into more marketable products, such as light oils and middle oils, but because the heavy oil fraction is laden with dust, it is very viscous and cannot be pipelined. Newly produced fresh shale oil has many free radicals and a transient chemical composition that rapidly polymerizes, ages, and degrades which greatly increases the viscosity of the oil and aggravates dust problems. Dust laden heavy oil plugs up hydrotreaters and catalytic crackers, abrades valves, heat exchangers, outlet orifices, pumps and distillation towers, builds up insulative layers on heat exchange surfaces reducing their efficiency and fouls up other equipment. Furthermore, the dusty heavy oil erodes turbine blades and creates emission problems. Moreover, the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at high temperatures and the product stream must be maintained at approximately the temperature attained during the retorting process to prevent any condensation and accumulation of dust on processing equipment. Maintaining the effluent stream at high temperatures allows detrimental side reactions, such as cracking, coking and polymerization of the effluent product stream, which tends to decrease the yield and quality of condensable hydrocarbons.

Over the years, various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 1,668,898; 1,687,763; 1,703,192; 1,707,759; 1,788,515; 2,235,639; 2,524,859; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,910,834; 3,929,625; 3,951,771; 3,974,073; 3,990,885; 4,028,222; 4,040,958; 4,049,540; 4,057,490; 4,069,133; 4,080,285; 4,088,567; 4,105,536; 4,151,067; 4,151,073; 4,158,622; 4,159,949; 4,162,965; 4,166,441; 4,182,672; 4,199,432; 4,220,522; 4,226,699; 4,246,093; 4,293,401; 4,324,651; 4,354,856; and 4,388,179 as well as in the articles by Rammler, R. W., *The Retorting of Coal, Oil Shale and Tar Sand By Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and Schmalfeld, I. P., *The Use of The Lurgi/Ruhrgas Process For The Distillation of Oil Shale,* Volume 70, Number 3, Quarterly of the Colorado School of Mines, pages 129–145 (July 1975).

The use of hydrogen donors, hydrogen, capping agents, and a variety of solvents have been suggested over the years for enhancing different aspects of oil shale retorting, coal liquefaction, catalytic cracking, and oil upgrading. Typifying these prior art processes are those shown in U.S. Pat. Nos. 2,847,306; 3,617,513; 3,779,722; 4,089,772; 4,094,766; 4,115,246; 4,133,646; 4,134,821; 4,178,229; 4,189,372; 4,293,404; 4,294,686; 4,298,451; 4,326,944; 4,330,394; 4,363,637; 4,375,402; and 4,324,637–644.

The above prior art processes have met with varying degrees of success.

It is therefore desirable to provide an improved process for producing and stabilizing shale oil.

SUMMARY OF THE INVENTION

An improved process is provided to stabilize oil produced from oil shale, tar sands, or oil-containing diatomaceous earth, in a manner which effectively and efficiently retards oil polymerization, aging and decrepitation. Desirably, the novel process increases agglomeration of oil dust and assures a higher quality product and yield at desirable viscosities.

In the process, the synthetic oil is hydroprocessed in a hydroprocessing reactor (hydroprocessor) to change the surface characteristics of the enhanced dust from hydrophobic to hydrophilic so that the water wet dust can more easily move from an oil phase to an aqueous phase in a deduster, such as a desalter. Hydroprocessing minimizes the rag or boundary layer/interface between the oil phase and aqueous phase in a desalter and partially upgrades the oil. Hydroprocessing further saturates the free radicals in the synthetic oil and enables better, easier, and more effective dedusting with greater dust removal and concomitant greater oil recovery because of less oil loss in the residual dust enriched sludge. Advantageously, stabilized oil can also be more readily pipelined and upgraded in hydrotreaters and catalytic crackers to form a higher quality syncrude.

Synthetic oil can be produced in this process above ground in surface retorts, or in solvent extraction vessels, or can be produced underground in modified or true in situ retorts. In the preferred form, the oil is produced in a surface retort, by mixing synthetic fuel in the retort with solid heat carrier material at a sufficient retorting temperature to liberate an effluent product stream of hydrocarbons containing entrained particulates of dust. The surface retort can be a static mixer retort, gravity flow retort, fluid bed retort, screw conveyor retort, or rotating pyrolysis drum retort. Such retorts typically include a surge bin, collection vessel, or accumulator. Other types of retorts such as rock pump retorts and rotating grate retorts can be used.

In the preferred form, the effluent product stream of hydrocarbons is partially dedusted in a cyclone, ceramic filter, or some other gas-solids separation device before being fed to at least one fractionator, quench tower, scrubber, or condenser where it is separated into one or more fractions of normally liquid synthetic oil. The dust laden fraction of whole synthetic oil or heavy synthetic oil is then dedusted in one or more dedusters (solids-liquids separation devices), such as desalters, hot centrifuges, dryers, filters, settlers, or extraction columns.

In order to more readily dedust the synthetic oil, the synthetic oil is pretreated in one or more hydroprocessors, such as hydrocrackers, catalytic crackers, or hydrotreaters, and most preferably an ebullated bed reactor. During pretreatment, the synthetic oil is contacted with a hydroprocessing gas in the presence of a stabilizing catalyst under hydroprocessing and product stabilizing conditions. The hydroprocessing gas can be hydrogen, scrubbed hydrocarbon gases from the fractionator (separator), and/or recycled hydrocarbon-enriched off gases from the ebullated bed reactor (hydroprocessor). Desirably, the hydroprocessing gas is preheated to a sufficient temperature before startup of the reactor to initiate the reaction between the catalyst, synthetic oil, and hydroprocessing gas. After startup, preheating can be decreased or stopped depending on the quantity of heat chemically generated in the reactor itself.

The hydroprocessing and stabilizing catalyst preferably has a hydrogenating component comprising one or more Group VIB or VIII metals, phosphorous, and/or vanadium on a suitable silica and/or alumina support. Other hydroprocessing and stabilizing catalysts can be used. The pore size of the support should be sufficient to trap trace metal removed from the synthetic oil.

The dedusted stabilized synthetic oil is preferably upgraded either alone or with refinery feedstock in one or more high severity reactors to remove nitrogen, oxygen, and sulfur species from the dedusted oil to form a high quality syncrude. Gases emitted in the high severity reactors can also be used as part or all of the hydroprocessing gas.

As used in this application, the term "dust" means particulates derived from solid hydrocarbon-containing material. The particulates range in size from less than 1 micron to 1000 microns and include retorted and raw unretorted particles of hydrocarbon-containing material, as well as spent hydrocarbon-containing material or sand, if the latter is used as solid heat carrier material during retorting. Duct derived from retorting of oil shale consists primarily of clays, calcium, magnesium oxides, carbonates, silicates, and silicas. Dust derived from the retorting or extraction of tar sands consists primarily of silicates, silicas, and carbonates.

The terms "retorted oil shale," "retorted hydrocarbon-containing material," and "retorted synthetic fuels" as used in this application refer to oil shale, solid hydrocarbon-containing material and synthetic fuels, respectively, which have been retorted to liberate hydrocarbons leaving an inorganic material containing carbon residue.

The terms "spent oil shale," "spent hydrocarbon-containing material," and "spent synthetic fuels." as used herein means oil shale, solid hydrocarbon-containing material, and synthetic fuels, respectively, from which most of the carbon residue has been removed by combustion.

The terms "solid hydrocarbon-containing material" and "synthetic fuels" as used herein mean oil shale, tar sands, and oil-containing diatomaceous earth (diatomite).

The term "synthetic oil" as used herein means oil which has been produced from oil shale, solid hydrocarbon-containing material, or synthetic fuels. The synthetic oil in the present process is dedusted according to the principles of the present invention before being fully upgraded.

The terms "dust-laden" or "dusty" synthetic oil as used herein mean synthetic oil which contains a substantial amount of entrained particulates of dust.

The term "dedusted" synthetic oil as used herein means synthetic oil from which a substantial amount of entrained particulates of dust has been removed in one or more dedusters or solid-liquid separation devices.

The term "syncrude" as used herein means dedusted synthetic oil which is subsequently upgraded in one or more reactors.

The term "hydroprocessing gas" as used herein means a gas which stabilizes synthetic oil in a hydroprocessor in the presence of a hydroprocessing catalyst.

The term "hydroprocessor" as used herein means a reactor in which hydroprocessing of synthetic oil takes place.

The term "hydroprocessing" as used herein means pretreating, processing or reacting dusty synthetic oil in a hydroprocessor with a hydroprocessing gas in the presence of a hydroprocessing catalyst under hydroprocessing conditions to stabilize the synthetic oil.

The term "hydroprocessing conditions" are conditions of pressure, temperature, feed rate, and LHSV (liquid hourly space velocity) in the hydroprocessor sufficient to react synthetic oil with a hydroprocessing gas in the presence of a hydroprocessing catalyst to stabilize the synthetic oil.

The terms "hydroprocessing catalyst," "stabilizing catalyst," and "hydroprocessing and stabilizing catalyst" as used herein mean a catalyst which enhances a reaction between synthetic oil and a hydroprocessing gas under hydroprocessing conditions to stabilize the synthetic oil.

The term "stabilize" as used herein includes saturating free radicals in synthetic oil.

The terms "normally liquid," "normally gaseous," "condensible," "condensed," or "noncondensable" are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENT

Figures 1, 2:
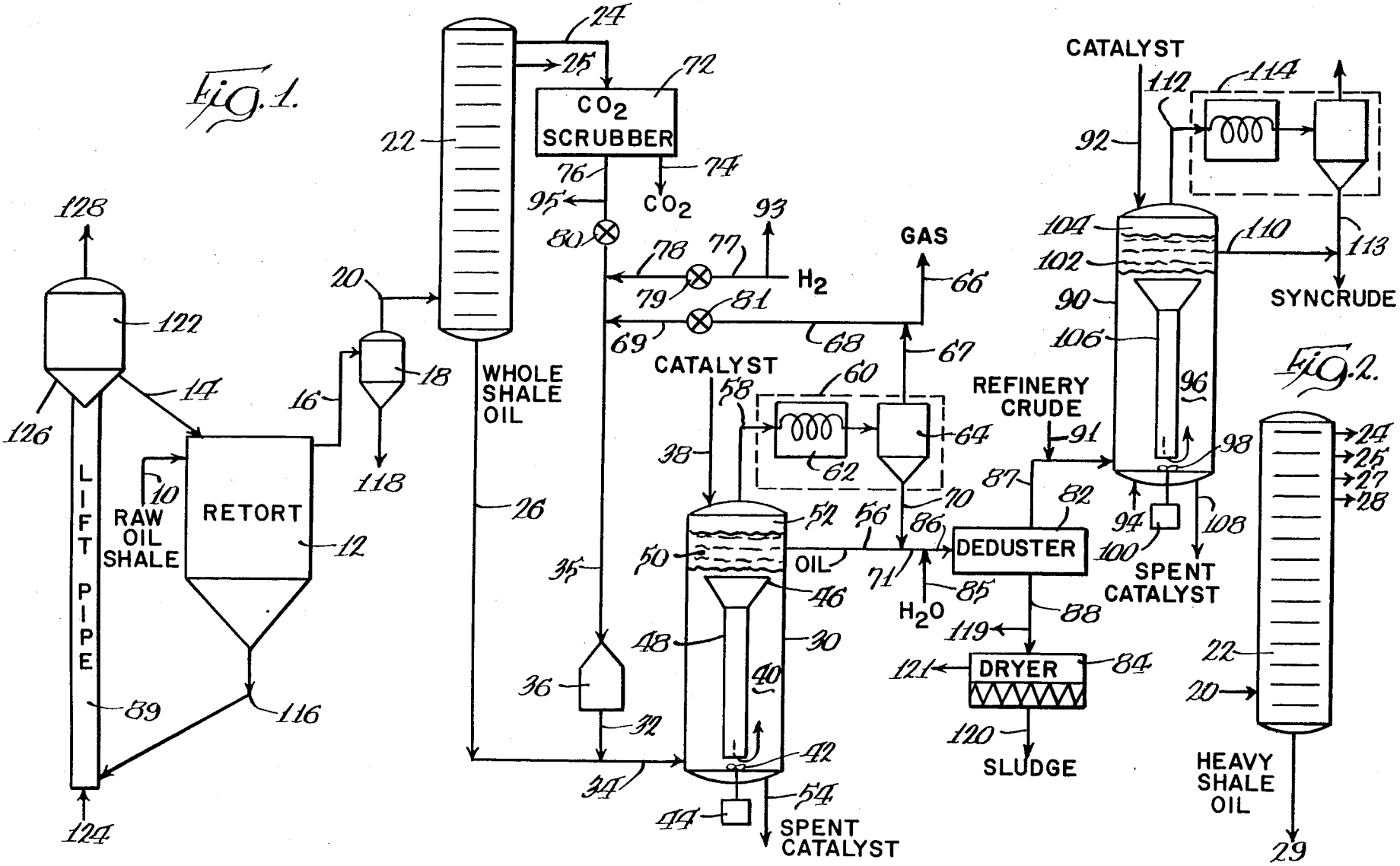
FIG. 1 is a schematic flow diagram of a process for producing, stabilizing, dedusting and upgrading shale oil in accordance with principles of the present invention.
FIG. 2 is a schematic flow diagram of an alternative part of the process.

Referring now to FIG. 1, an oil shale retorting and shale oil stabilizing and upgrading process and system is provided to produce, stabilize, dedust and upgrade synthetic oil from solid hydrocarbon-containing material, such as oil shale, tar sands, and oil-containing diatomaceous earth (diatomite). While the present invention is described hereinafter with particular reference to the processing of oil shale, it will be apparent that the process and system can also be used in connection with the processing of other hyrocarbon-containing materials, such as tar sands and oil-containing diatomaceous earth.

In the process and system, raw, fresh oil shale, which preferably contains an oil yield of at least 15 gallons per ton of shale particles, is crushed and sized to a maximum fluidizable size of 10 mm and fed through raw shale inlet line 10 at a temperature from ambient temperature to 600° F. into an aboveground surface retort 12. The retort can be a gravity flow retort, a static mixer retort with a surge bin, a fluid bed retort, a rotating pyrolysis drum retort with an accumulator having a rotating trommel screen, or a screw conveyor retort with a surge bin. The fresh oil shale can be crushed by conventional crushing equipment, such as an impact crusher, jaw crusher, gyratory crusher, roll crusher, and screened with conventional screening equipment, such as a shaker screen or a vibrating screen.

Spent (combusted) oil shale and spent (combusted) dried sludge, which together provide solid heat carrier material, are fed through heat carrier line 14 at a temperature from 1000° F. to 1400° F., preferably from 1200° F. to 1300° F., into the retort to mix with heat and retort the raw oil shale in the retort. The retorting temperature of the retort is from 850° F. to 1000° F., preferably from 900° F. to 960° F., near atmospheric pressure. Air and molecular oxygen are prevented from entering the retort in order to prevent combustion of oil shale, shale oil and liberated gases in the retort.

In a fluid (fluidized) bed retort, fluidizing lift gas, such as light hydrocarbon gases, are injected into the bottom of the retort through a gas injector to fluidize, entrain and enhance mixing of the raw oil shale and solid heat carrier material in the retort. Other types of retorts, such as a fixed bed retort, a rock pump retort, or a rotating or a reciprocating grate retort, can be used with a gaseous heat carrier material in lieu of solid heat carrier material.

During retorting, hydrocarbons, carbon dioxide, and steam are liberated from the raw oil shale as a gas, vapor, mist or liquid droplets and most likely a mixture thereof along with entrained particulates of oil shale (dust) ranging in size from less than 1 micron to 1000 microns. The effluent product stream of hydrocarbons, carbon dioxide, and steam liberated during retorting is withdrawn from the upper portion of the retort through an overhead product line 16.

The product stream is passed to one or more internal or external gas-solid separating devices, such as a cyclone 18 or a filter. The gas-solid separating device partially dedusts the effluent product stream. The partially dedusted stream exits the cyclone through transport line 20 where it is transported to one or more separators 22, such as quench towers, scrubbers or fractionators, also referred to as fractionating columns or distillation columns.

In the separator 22, the effluent product stream is separated into fractions of light hydrocarbon gases and carbon dioxide, steam, whole shale oil (FIG. 1) or light shale oil, middle shale oil, and heavy shale oil (FIG. 2). These fractions are discharged from the separator through lines 24–29, respectively. Whole shale oil comprises heavy shale oil, middle shale oil, and light shale oil. Heavy shale oil has a boiling point over 600° F. to 800° F. Middle shale oil has a boiling point over 400° F. to 500° F. and light shale oil has a boiling point over 100° F.

The solids bottom heavy shale oil fraction in the bottom separator line 29 (FIG. 2) is a slurry of dustladen heavy shale oil that contains from 15% to 45% by weight of the effluent product stream. The dust-laden heavy oil, which is also referred to as "dusty oil," consists essentially of normally liquid heavy shale oil and from 1% to 65% by weight entrained particulates of oil shale dust, preferably at least 25% by weight oil shale dust for reasons of dedusting efficiency and economy. Whole shale oil in line 26 (FIG. 1) contains from 1% to 15%, typically about 10% by weight entrained particulates of oil shale dust. Oil shale dust is mainly minute particles of spent oil shale and lesser amounts of retorted and/or raw oil shale particulates. The temperature in the separator can be varied from 500° F. to 800° F., preferably about 600° F., at atmospheric pressure and controlled to assure that essentially all of the oil shale dust gravitates to and is entrained in the solids bottom oil fraction. Dust-laden heavy oil has an API gravity from 5° to 20° and a mean average boiling point from 600° F. to 950° F.

Untreated shale oil contains various contaminants such as nitrogen, sulfur, oxygen, and trace metals, such as arsenic, iron, vanadium and nickel. These contaminants along with the shale dust need to be substantially removed from the shale oil in order to produce a marketable, high quality oil product.

In order to more effectively dedust the shale oil and remove a substantial portion of these contaminants, the dusty shale oil is fed to a hydroprocessor or hydroprocessing reactor 30, preferably an ebullated bed reactor, where the dusty oil is contacted, ebullated, and mixed in an ebullated flow pattern with a hydroprocessing gas in the presence of a hydroprocessing and stabilizing catalyst under hydroprocessing conditions. In the preferred embodiment, the hydroprocessing gas in hydroprocessing gas line 32 is injected into the shale oil upstream of the ebullated bed reactor so that the shale oil and hydroprocessing gas can be partially premixed before entering the reactor through gas/oil line 34. While the above system is preferred for best results, in some circumstances it may be desirable to separately feed the shale oil and hydroprocessing gas into the hydroprocessor.

Before startup of the reactor 30, the hydroprocessing gas in gas line 35 is preferably heated, by a furnace or heater 36, so that the combined stream of hydroprocessing gas and shale oil in gas/oil line 34 entering the ebullated bed reactor is at least 400° F. to 500° F. in order to initiate the reaction of the shale oil and hydroprocessing gas with the hydroprocessing catalyst. After startup, the reactor usually generates enough internal heat from the reaction to drive and sustain itself, and the heater 36 can be shut off, lowered, or adjusted to control the feed temperature of dusty oil/hydroprocessing gas in gas/oil line 34 from 150° F. to 600° F. and preferably from 250° F. to 550° F.

Fresh makeup hydroprocessing catalyst enters the top of the ebullated bed reactor through fresh catalyst line 38. The hydroprocessing catalyst has a hydrogenating component, such as one or more Group VIB or VIII metals, phosphorous, and/or vanadium, preferably nickel, cobalt, molybdenum, tungsten and combinations thereof on a suitable support of silica and/or alumina, or various molecular sieves having a pore size sufficient to trap the trace metals from the shale oil. Other hydroprocessing catalysts which react with shale oil and hydroprocessing gas to stabilize the shale oil, agglomerate the dust, and remove trace metals can also be used.

In the ebullated bed reactor, the dusty shale oil and hydroprocessing gas are mixed and circulated with the ebullated bed 40 of hydroprocessing catalyst by an agitator 42 of an internal or external pump 44 in an ellipitical ebullated flow pattern to form an expanded ebullated catalyst bed 40 at a level above the frustroconical flared inlet or mouth 46 of the central catalyst standpipe and chamber 48. The ebullated bed reaction also forms a slurry of shale oil and shale dust providing an expanded shale oil dust bed 50 above the catalyst bed and a bed or layer 52 of hydrocarbon-rich off gas above the shale oil/dust bed. The hydroprocessing catalyst is circulated downwardly through the standpipe and generally upwardly through other portions of the catalyst bed. The hydroprocessing catalyst removes and entraps most of the trace metals in the shale oil.

Catalysts which contain the removed trace metals fall to the bottom of the reactor as spent catalyst and are removed from the reactor through spent catalyst line 54. The metal content and composition of the spent catalyst and applicable environmental safety laws are factors in determining how to dispose of the spent catalyst and the feasibility of spent catalyst regeneration.

One or more fluid bed reactors or fixed bed reactors cn be used as the hydroprocessor, although ebullated bed reactors, which are also referred to as back mix reactors, are particularly useful as the hydroprocessor because of their ability to comfortably handle and operate with sizable shale dust loads. Ebullated bed reactors also have less chance of coking, plugging and shale dust fouling as well as have a longer operational lifespan with less system shutdown than many other types of reactors. Catalysts can also be continuously fed and removed from an ebullated bed reactor.

The reaction of the shale oil and hydroprocessing gas (reactants) with the hydroprocessing catalyst in the hyrdoprocessor is referred to as "hydroprocessing" or a "hydroprocessing reaction." As a result of hydroprocessing, the shale oil is stabilized. Free radicals, olefins, diolefins, and other hydrogen deficient molecules in the shale oil are saturated. Polymerization of the shale oil is limited. Shale oil aging is retarded. Degrading of oil is minimized. Substantial amounts of oxygen, sulfur and trace metals are removed from the shale oil. The shale oil is partially upgraded. A substantial portion of the oil shale dust is agglomerated. The surface characteristics of the shale dust change from hydrophobic to hydrophilic.

The resultant stabilized shale oil is a more valuable product which is simpler, and less expensive to dedust. Hydroprocessing provides greater oil yield and recovery as well as higher dust removal in many types of dedusters than prior art methods. Hydroprocessing also minimizes the rag, boundary layer, and interface between oil and water or solvent phases in dedusters. Hydroprocessed stabilized shale oil is also less viscous (thick) than untreated shale oil and is easier to pipeline and upgrade.

Typical hydroprocessing operating conditions in the hydroprocessor are: total pressure from 500 psia to 6000 psia, preferably 1200 psia to 3000 psia; hydrogen partial pressure from 500 psia to 3000 psia, preferably from 1200 psia to 2000 psia; hydroprocessing gas flow rate (injection rate) from 4000 SCFB to 10,000 SCFB, and LHSV (liquid hourly space velocity) from about 0.2 to about 4 volumes of hydrocarbons per hour of catalyst. These operating conditions tend to avoid removing a substantial amount of the nitrogen components in the shale oil and are useful in enhancing the stabilizing/hydroprocessing reaction.

The stabilized shale oil is removed from the ebullated bed reactor through stabilized oil line 56. Reactor off gases are withdrawn from the ebullated bed reactor though overhead off gas line 58 and passed to a recovery system 60. The reactor off gases are rich in hydrocarbons and contain lesser amounts of hydrogen sulfide, ammonia, and stabilized shale oil vapors. The recovery system preferably has an air or water heat exchanger or cooler 62 followed by one or more flash drums 64. The cooler cools the reactor off gases to condense and liquify the oil vapors. The flash drum flashes and separates the hydrocarbon-enriched off gases from the shale oil condensate. Part of the hydrocarbon-enriched off gases can be bled off, purged, and released to the atmosphere through bleed line 66 via gas line 67. The remainder of the hydrocarbon enriched off gases can be recycled, fed to, and combined with the hydroprocessing gas in hydroprocessor line 32 through recycled off gas line 67-69 for use as part or all of the hydroprocessing gas. The shale oil condensate is withdrawn through condensate line 70 and fed and combined with the stabilized shale oil in line 56 through stabilized shale oil line 71.

The gaseous fraction of hydrocarbon gased and carbon dioxide are withdrawn from the fractionator 22 through gas line 24 and fed to a $CO_2$ scrubber 72. In the scrubber, the carbon dioxide is scrubbed and removed from the gaseous fraction through $CO_2$ line 74. The scrubbed hydrocarbon gases can be injected, fed to, and combined with the hydroprocessing gas in hydroprocessing line 35 through hydrocarbon gas line 76 for use as part or all of the hydroprocessing gas. If desired, part or all of the unscrubbed gaseous fraction, or a $C_4+$ cut or heavier thereof, can be fed directly into the hydroprocessor. The $C_4+$ cut can be separated from the gaseous fraction by distillation, cryogenic processing, oil wash absorption, compression and cooling, or by other processing techniques.

Makeup, fresh hydroprocessing gas, preferably containing at least 95% by weight hydrogen, from a hydrogen plant or some other source can be fed through hydrogen lines 77 and 78 into the hydroprocessing gas line 32 for use as part or all of the hydroprocessing gas. The amount of hydrogen, scrubbed hydrocarbon gases, and hydrocarbon-enriched reactor gas entering the hydroprocessing gas line are controlled by flow control valves 79, 80, and 81, respectively.

The stabilized dusty shale oil in line 71 is dedusted in one or more dedusters (solids-liquid separation devices) 82, such as desalters, hot centrifuges, and/or dryers, and otherwise processed as described in U.S. Pat. Nos. 4,404,085; 4,415,430; and 4,415,434; which are hereby expressly incorporated by reference. In the preferred process, the deduster takes the form of one or more desalters 82 which can be followed by a screw conveyor (porcupine) dryer 84. Water from water line 85 is injected into the stabilized dust-laden shale oil to form an emulsion. The emulsion is fed through emulsion line 86 into the desalter. In the desalter (deduster), the stabilized dust-laden oil is separated into a dedusted stream of stabilized shale oil, which exits the deduster through dedusted product line 87, and a residual dust-enriched aqueous stream of sludge containing water and substantially all of the shale dust, which exits the bottom of the deduster through sludge line 88. The sludge is fed to a combustor lift pipe 89 to combust the coke and any entrapped oil on the shale dust for use as supplemental fuel and heat for the process, either directly or after being dried in a dryer 84 to remove any residual oil via line 121.

The dedusted stabilized stream of shale oil in oil line 87 is fed to one or more high severity upgrading reactors 90, such as hydrocrackers, catalytic crackers, and hydrotreaters, preferably fixed bed reactors and fluid bed reactors and most preferably an ebullated bed reactor. If desired, the dedusted stabilized shale oil can also be blended with refinery feedstock/crude oil from line 91 before being fed to the upgrading reactor. Fresh, makeup high severity upgrading catalyst is fed into the top of the upgrading reactor through fresh catalyst line 92. An upgrading gas, such as hydrogen from line 93, or hydrocarbon-enriched hydroprocessor off gases from line 95, or the scrubbed fractionator gases from line 74, is injected through injection line 94 into the upgrading reactor either directly or indirectly after being mixed with the shale oil feedstock.

In the upgrading reactor, the dedusted stabilized shale oil is contacted, circulated, ebullated, and mixed with the upgrading gas in the presence of an ebullated bed 96 of upgrading catalyst by an agitator 98 of an internal or external pump 100 in an elliptical ebullated flow pattern under high severity operating/upgrading conditions. The high severity operating/upgrading conditions in the upgrading reactor are similar to the hydroprocessing conditions of the hydroprocessor, except that the pressure and temperature of the upgrading reactor are substantially higher than in the hydroprocessor. The upgrading catalyst can be similar to the hydroprocessing catalyst.

The upgrading reaction forms a slurry/bed 102 of shale oil above the expanded catalyst bed 96 and a bed or layer 104 of hydrogen rich reaction gases above the oil slurry. The catalyst is circulated downwardly through the standup 106 and generally upwardly through other portions of the catalyst bed. Spent catalyst is removed from the reactor through spent catalyst line 108. Upgraded oil is removed from the reactor through product line 110. The hydrogen-rich reaction gases are removed from the reactor through overhead gas line 112. Any shale oil vapors contained in the reaction gas can be condensed and removed in a recovery system 114 similar to the hydroprocessing recovery system 60 and fed and combined with the upgraded shale oil in product line 110 via condensate line 113. The hydrogen-rich reaction gases can also be recycled and used as part of the hydroprocessing gas.

In the upgrading reactor, the dedusted stabilized shale oil is further upgraded to remove nitrogen components and any remaining amounts of sulfur, oxygen and trace metals in the shale oil. In the preferred process, upgrading is substantially completed in the upgrading reactor. The fully upgraded, dedusted stabilized shale oil provides a more marketable, high quality shale oil or syncrude.

Retorted and spent oil shale particles from the retort 12 are discharged through the bottom of the retort and are fed by gravity flow or other conveying means through combustor feed line 116 to the bottom portion of an external dilute phase, vertical lift pipe combustor 89. The lift pipe 89 is spaced away and positioned remote from the retort. Shale dust removed from the product stream in cyclone 18 can also be conveyed by gravity flow or other conveying means through dust outlet line 118 to the bottom portion of the combustor lift pipe. Sludge from the deduster can also be fed from sludge line 119 to the bottom of the lift pipe combustor, or through dryer discharge line 120 after being dried in the dryer.

In the lift pipe combustor 89, the retorted shale sludge, and heat carrier materials are fluidized, entrained, propelled and conveyed upwardly into an overhead collection and separation bin 122 by air injected into the bottom portion of the lift pipe through air injection nozzle 124. Shale oil and any carbon residue in the sludge are substantially completely combusted in the lift pipe along with residual carbon on the retorted shale and shale dust. The combustion temperature in the lift pipe overhead vessel is from 1000° F. to 1400° F. The combusted spent sludge, combusted oil shale, and combusted spent shale dust are discharged through an outlet in the bottom of the overhead bin into heat carrier feed line 14 for use as solid heat carrier material in the retort 12. Excess spent shale and sludge are withdrawn from the overhead bin and retort system through discharge line 126.

The carbon contained in the retorted oil shale and sludge are burnt off mainly as carbon dioxide during combustion in the lift pipe and overhead bin. The carbon dioxide along with the air and other products of combustion form combustion off gases or flue gases which are withdrawn from the upper portion of the overhead bin through a combustion gas line 128. The combustion gases are dedusted in an external cyclone or an electrostatic precipitator before being discharged into the atmosphere or processed further to recover steam.

While an external dilute phase lift pipe combustor is preferred for best results, in some circumstances it may be desirable to use other types of combustors, such as a horizontal combustor, a fluid bed combustor or an internal dilute phase lift pipe which extends vertically through a portion of retort. If ceramic and/or metal balls are used as the solid heat carrier material, such as for rotating pyrolysis drum retorts, the retorting system should also have a ball separator, such as a rotating trommel screen, and a ball heater in lieu or in combination with the combustor.

Residual oil in the sludge provides auxiliary fuel for the lift pipe combustor. Light hydrocarbon gases or shale oil can also be fed to the lift pipe to augment the fuel.

Among the many advantages of the above process are:

1. Better product quality and yield.
2. Enhanced retorting and upgrading economy.
3. Improved shale oil stabilization.
4. Decreased oil polymerization and decrepitation.
5. Increased agglomeration of oil shale dust.
6. Better dedusting and process efficiency.
7. Retarding of shale oil aging.
8. Viscosity control.
9. Less rag.
10. Easier dedusting and shale oil pipelining.

Although embodiments of this invention have been shown and described, it is to be understood that various modifications and sustitutions, as well as rearrangements of parts, components, equipment and/or process steps, can be made by those skilled in the art without departing from the novel spirit and scope of this invention.

What is claimed is:

1. A process for producing syncrude, comprising the steps of:

(a) feeding raw oil shale into a surface retort selected from the group consisting essentially of a screw conveyor retort with a surge bin, a rotating pyrolysis drum with an accumulator having a rotating trommel screen, a fluid bed retort, a static mixer retort with a surge bin, and a gravity flow retort;

(b) feeding solid heat carrier material at a temperature ranging from 1000° F. to 1400° F. into said retort;

(c) retorting said raw oil shale by contacting said raw oil shale with said solid heat carrier material in said retort at a temperature to liberate an effluent product stream comprising hydrocarbons, trace metals, and entrained particulates of raw, retorted an combusted oil shale dust ranging in size from less than one micron to 1000 microns; said trace metals comprising arsenic, iron, vanadium, and nickel;

(d) withdrawing said product stream from said retort;

(e) partially dedusting said product stream in at least one gas-solids separation device selected from the group consisting essentially of a cyclone and a filter;

(f) separating a shale oil fraction of normally liquid shale oil containing a substantial portion of said trace metals and from 1% to 65% by weight of said shale dust and a gaseous fraction comprising hydrocarbon gases and carbon dioxide from said partially dedusted product stream in at least one separator selected from the group consisting essentially of a fractionator, scrubber, and quench tower;

(g) feeding said shale oil fraction to a hydroprocessor;

(h) feeding a hydroprocessing catalyst to said hydroprocessor;

(i) injecting a hydroprocessing gas into said hydroprocessor;

(j) stabilizing, limiting polymerization, and partially upgrading said shale oil fraction while simultaneously removing a substantial portion of said trace metals from said shale oil fraction and agglomerating a substantial portion of said shale dust by contacting said shale oil fraction with said hydroprocessing gas in the presence of said hydroprocessing catalyst in said hydroprocessor under hydroprocessing conditions to form a stabilized shale oil fraction containing agglomerated shale dust and a hydrocarbon-enriched gaseous stream containing shale oil vapors leaving a spent hydroprocessing catalyst containing a substantial portion of said trace metals;

(k) removing said spent hydroprocessing catalyst from said hydroprocessor;

(l) removing said stabilized shale oil fraction from said hydroprocessor;

(m) withdrawing said hydrocarbon-enriched gaseous stream from said hydroprocessor;

(n) condensing and removing said stabilized shale oil vapors from said hydrocarbon-enriched gaseous stream;

(o) mixing said condensed stabilized shale oil vapors with said shale oil fraction to form a stream of stabilized shale oil;

(p) dedusting said stabilized shale oil by separating said stabilized shale oil in at least one deduster into a dedusted stream of stabilized shale oil and a dust enriched water stream of sludge containing most of said agglomerated dust;

(q) feeding and combusting said retorted shale and said dust enriched water stream of sludge to at least one combustor selected from the group consisting of a lift pipe combustor, a generally horizontal combustor, and a fluid bed combustor, to form combusted shale and sludge, respectively, for use as solid heat carrier material in steps (b) and (c); and (r) removing nitrogen, oxygen and sulfur from said dedusted stream in at least one upgrading reactor selected from the group consisting of a hydrotreater, hydrocracker, and catalytic cracker in the presence of an upgrading catalyst under high severity upgrading conditions to form syncrude.

2. A process in accordance with claim 1 wherein step (j) includes changing the characteristics of said shale dust from hydrophobic to hydrophilic.

3. A process in accordance with claim 2 including emulsifying said stabilized shale oil containing said hydrophilic shale dust by injecting water into said stabilized shale oil and dedusting said emulsified shale oil in at least one desalter.

4. A process in accordance with claim 1 including substantially drying said sludge in a dryer before said combustion.

5. A process in accordance with claim 1 wherein step (j) comprises saturating free radicals olefins, diolefins, and other hydrogen deficient molecules in said shale oil.

6. A processs in accordance with claim 1 wherein said hydroprocessor is an ebullated bed reactor and said shale oil fraction is ebullated with said hydroprocessing gas and said hydroprocessing catalyst in said ebullated bed reactor.

7. A process in accordance with claim 6 wherein said hydroprocessing gas and said shale oil are heated to at least 400° F. prior to startup of said ebullated bed reactor before step (i).

8. A process in accordance with claim 6 wherein said hydroprocessing gas comprises hydrogen.

9. A process in accordance with claim 6 wherein said hydrogen-enriched gaseous stream is injected into said ebullated bed reactor after step (m) as part of said hydroprocessing gas.

10. A process in accordance with claim 9 wherein:

said hydrocarbon enriched gases stream further contains ammonia and hydrogen sulfide; and step (n) comprises cooling said hydrogen enriched gaseous stream in a cooler and separating said shale oil vapors from said cooled stream in a flash drum.

11. A process in accordance with claim 6 wherein said gaseous fraction is scrubbed of carbon dioxide and said scrubbed gaseous fraction is injected into said ebullated bed as part of said hydroprocessing gas.

12. A process in accordance with claim 6 wherein said dedusted stream is mixed with refinery feedstock before step (h).

13. A process in accordance with claim 6 wherein said hydroprocessing catalyst comprises a hydrogenating component selected from the group consisting of a Group VIB metal, a Group VIII metal, phosphorous, vanadium, and combinations thereof, on a support selected from the group consisting of silica, alumina, and combinations thereof, said support having a sufficient pore size to trap said trace metals.

14. A process in accordance with claim 6 wherein said hydroprocessing gas in injected into said shale oil fraction upstream of said ebullated bed reactor and said hydroprocessing gas and said shale oil fraction are fed together into said ebullated bed reactor.

15. A process in accordance with claim 6 wherein step (r) includes contacting said dedusted stream with an upgrading gas in the presence of said upgrading catalyst in said upgrading reactor.

16. A process in accordance with claim 15 wherein said upgrading gas comprises hydrogen.

17. A process in accordance with claim 15 wherein said upgrading gas comprises at least some of said hydrocarbon-enriched gaseous stream from said hydroprocessor.

18. A process in accordance with claim 15 wherein step (r) includes emitting hydrogen-rich off gases in said upgrading reactor and recycling said hydrogen-rich off gases for use as part of said hydroprocessing gas in said hydroprocessor.

19. A process in accordance with claim 1 including feeding said gaseous fraction from said separator into said hydroprocessor.

20. A process in accordance with claim 1 including separating a $C_4+$ cut from said gaseous fraction and feeding said $C_4+$ cut to said hydroprocessor.

21. A process in accordance with claim 1 wherein said shale oil in said shale oil fraction consists essentially of whole shale oil.

22. A process in accordance with claim 1 wherein said shale oil in said shale oil fraction consists essentially of heavy shale oil.

* * * * *

UNITED STATES PATENT OFFICE
CERTIFICATE OF CORRECTION

Patent No. 4,548,702 Dated October 22, 1985

Inventor(s) Earl D. York, David M. Johnson, Paul B. Miller

It is certified that error appears in the above-identified patent and that said Letters Patent are hereby corrected as shown below:

Front Page, Item 73 reads "Standard Oil Company; Gulf Oil Corporation, both of Chicago, Ill." and should read --Standard Oil Company (Indiana), Chicago, Illinois and Gulf Oil Corporation, Pittsburgh, Pennsylvania--

| Patent Column | Line | |
|---|---|---|
| 12 | 47 | reads "an" and should read --and-- |
| 4 | 3 | reads "enhanced" and should read --entrained-- |
| 4 | 66 | reads "metal" and should read --metals-- |
| 5 | 13 | reads "Duct" and should read --Dust-- |
| 5 | 27 | reads "." and should read --,-- |
| 8 | 38 | reads "ellipitical" and should read --elliptical-- |
| 8 | 59 | reads "cn" and should read --can-- |
| 9 | 40 | reads "though" and should read --through-- |

Signed and Sealed this

*Twenty-second* Day of *July 1986*

[SEAL]

*Attest:*

DONALD J. QUIGG

*Attesting Officer* *Commissioner of Patents and Trademarks*